US007377011B2

(12) United States Patent
Sakakura

(10) Patent No.: US 7,377,011 B2
(45) Date of Patent: May 27, 2008

(54) CURTAIN WAVE FORMING MECHANISM

(75) Inventor: Yoshinobu Sakakura, Tokyo (JP)

(73) Assignee: Toso Company, Limited, Tokyo (JP)

( * ) Notice: Subject to any disclaimer, the term of this patent is extended or adjusted under 35 U.S.C. 154(b) by 71 days.

(21) Appl. No.: 10/572,592

(22) PCT Filed: Sep. 22, 2004

(86) PCT No.: PCT/JP2004/013813

§ 371 (c)(1),
(2), (4) Date: Mar. 20, 2006

(87) PCT Pub. No.: WO2005/034695

PCT Pub. Date: Apr. 21, 2005

(65) Prior Publication Data

US 2007/0163078 A1 Jul. 19, 2007

(30) Foreign Application Priority Data

Oct. 9, 2003 (JP) ..... 2003-351013

(51) Int. Cl.
*E05D 15/00* (2006.01)

(52) U.S. Cl. ..... 16/87.6 R; 16/87.2

(58) Field of Classification Search ..... 16/87.6 R, 16/87.2, 87 R, 87.4 R, 97, 102; 160/166.1, 160/167 R, 167 V, 168.1 R, 174 R, 176.1 R, 160/330, 340, 341, 345–347, 123; 49/409, 49/410, 411–412

See application file for complete search history.

(56) References Cited

U.S. PATENT DOCUMENTS 3,178,760 A * 4/1965 Kalal et al. ..... 16/87.6 R
4,525,893 A * 7/1985 Fukada ..... 16/102
4,675,939 A * 6/1987 Fukada ..... 16/87.2
4,964,191 A * 10/1990 Wyatt ..... 16/87.2
5,111,867 A * 5/1992 Horton et al. ..... 160/330

FOREIGN PATENT DOCUMENTS

| | | | |
|---|---|---|---|
| FR | 2371171 A | * | 7/1978 |
| JP | 57-76585 U | | 5/1982 |
| JP | 1-157801 U | | 10/1989 |
| JP | 2-57478 U | | 4/1990 |
| JP | 4-6627 Y2 | | 2/1992 |

(Continued)

*Primary Examiner*—Chuck Y. Mah
(74) *Attorney, Agent, or Firm*—Birch, Stewart, Kolasch & Birch, LLP

(57) ABSTRACT

A curtain wave forming mechanism is constituted of curtain runners and a curtain hook attached to each curtain runner and hanging a curtain. The curtain hook is a separate body from a curtain tape and has a flat plate-like body section inserted into a hook insertion hole section of the curtain tape perpendicular to the length direction of a curtain rail, a foot section bent upward at the lower end central part of the body section and hooked to the hook insertion hole section, a shaft section extending from the upper central part of the body section, and a head section for insertion, formed on the head of the shaft section. A curtain runner has a body running in the curtain rail, a leg section hanging from the curtain rail, a hollow-cylindrical body supported at the leg section so as to be rotatable about the vertical axis of the leg section, and a bearing section for an insertion hook, supported at the hollow-cylindrical body.

7 Claims, 5 Drawing Sheets

FOREIGN PATENT DOCUMENTS

| | | | | |
|---|---|---|---|---|
| JP | 5-22145 | Y2 | | 6/1993 |
| JP | 2527010 | Y2 | | 11/1996 |
| JP | 9-327374 | A | | 12/1997 |
| JP | 2001-327394 | A | | 11/2001 |
| JP | 2002209721 | A | * | 7/2002 |
| JP | 2003-235721 | A | | 8/2003 |

* cited by examiner

CURTAIN WAVE FORMING MECHANISM

CROSS-REFERENCE TO RELATED APPLICATION

The present application claims priority under 35 U.S.C. §119 to Japanese Patent Application No. 2003-351013, filed Oct. 9, 2003, and International Application PCT/JP2004/013813 filed Nov. 17, 2004, the entire contents of which are hereby incorporated by reference.

BACKGROUND OF THE INVENTION

1. Field of the Invention

The present invention relates to a curtain wave forming mechanism, which comprises a plurality of curtain runners installed in a curtain rail and curtain hooks attached to the respective curtain runners for hanging a curtain.

2. Description of Background Art

A curtain is expected to form a naturally elegant curtain wave when it is suspended by the use of flat wide curtain hooks each being vertically rotatably attached to a curtain runner, because the curtain hooks rotate integrally with the curtain without preventing the curtain from forming a curtain wave. In a curtain rail in which the pitch (maximum interval) of curtain runners is determined, the curtain forms a curtain wave of which the nodes are identical in position with the respective curtain runners, each wave cycle having a contour length equal to twice the pitch of curtain hooks and a height defined by the pitch of the curtain hooks.

It has been disclosed in JP Y 5-22145 that flat wide curtain hooks are used for making a curtain to form a curtain wave. The curtain hooks are integral with a curtain tape and fixed onto the surface of the curtain tape at a given distance from one another, each curtain hook having a flat wide body section and an insertion hook section extending from the upper part of the body section. The insertion-type hooks have their flat wide body sections fixed to the surface of the curtain tape at a given distance from one another and their hook sections vertically rotatably lowered from the respective curtain runners, so that the curtain forms a naturally elegant wave.

However, the conventional flat wide insertion-type hook has a problem that, in the curtain rail in which the pitch (maximum interval) of curtain runners is determined, it is impossible to adjust the height of wave without exchanging the curtain tape, because the hooks are integral with the curtain tape. Furthermore, it is another problem that the conventional curtain runner is unable to keep the direction of the curtain hook with the result that the curtain wave is apt to fall into disorder in the lead and tail portions of the curtain. It is a further problem that the conventional flat wide curtain hook with the insertion hook section is unfit for an ordinary ring-type curtain runner.

Reference: JP Y 5-22145

SUMMARY AND OBJECTS OF THE INVENTION

The present invention is intended to solve the problems described above and provide a curtain wave forming mechanism constituted of a plurality of curtain runners mounted in a curtain rail and curtain hooks attached to the respective curtain runners for hanging a curtain, the mechanism allowing the curtain wave to be adjusted without involving an exchange of the curtain tape, preventing the curtain wave from falling into disorder in the lead and tail portions of the curtain, being also applicable to an ordinary ring-type curtain runner.

According to the present invention, the curtain wave forming mechanism comprising a plurality of curtain runners disposed in a curtain rail and curtain hooks each being fitted in one of the curtain runners for hanging a curtain, characterized in that the curtain hook, as a separate body from a curtain tape, has a flat plate-like body section inserted into a hook insertion hole section of the curtain or curtain tape perpendicular to the length direction of the curtain rail, a foot section bent upward at the lower end central part of the body section and hooked to the hook insertion hole section, a shaft section extending from the upper central part of the body section and a head section for insertion or hook-and-ring, formed on the upper end part of the shaft section, and that the curtain runner has a main body running through the curtain rail, a leg section of the main body lowering from the curtain rail, a hollow-cylindrical body supported at the leg section so as to be rotatable about the vertical axis of the leg section, and a bearing section for insertion or hook-and-ring, supported at the hollow-cylindrical body.

The curtain runner comprises a main body running in the curtain rail, a leg section hanging from the curtain rail, a hollow-cylindrical body supported at the leg section so as to be rotatable about the vertical axis of the leg section and a bearing section for insertion or hook-and-ring, supported at the hollow-cylindrical body. It is also characterized in that the curtain hook for use with the lead or tail portion of the curtain is formed with pins extending upward from the both upper ends of the body section and that the curtain runner for use with lead or tail portion of the curtain is formed at the both sides of the leg section with receivers for retaining the pins.

According to the present invention, the curtain hook, as a separate body from a curtain tape, has a flat plate-like body section, a foot section bent upward at the lower end central part of the body section, a shaft section extending from the upper central part of the body section and a head section for insertion or hook-and-ring, the body section being the almost same in width to the length direction of the curtain rail as the hook insertion hole section of the curtain or curtain tape. Therefore, the curtain hooks are fitted at desirable intervals in the hook insertion hole sections of the curtain or curtain tape aligning to the length direction of the curtain rail so that the height of curtain wave is freely adjusted without involving an exchange of the curtain tape. The body sections are inserted into and hooked in the wide hook insertion hole sections of the curtain or curtain tape perpendicular to the length direction of the curtain rail in a manner that the hanging curtain forms its naturally elegant wave. The curtain hook with the bearing section for hook-and-ring is used for an ordinary ring-type curtain runner.

According to the present invention, the curtain hook for use with the lead or tail portion of the curtain has pins extending upward from the both upper side ends of the body section and that the curtain runner has receivers formed at the both sides of the leg section to retain the pins in a manner that the lead or tail portion of the curtain stands perpendicular to the length direction of the curtain rail. This ensures that the lead or tail portion of the curtain forms their wave pattern.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

A curtain hook consists of a flat plate-like body section to be inserted into a hook insertion hole section of a curtain tape, a foot section bent upward at the lower end of the body section to hook in the hook insertion hole section, a shaft section extending from the body section to a thick head, and a head section for insertion or hook-and-ring formed at the upper end of the thick head, wherein the body section are essentially similar in width to the insertion hook hole section in the length direction of the curtain tape so that the curtain hook is removably inserted into and hooked in the hook insertion hole section perpendicular to the length direction of the curtain tape.

In order for the curtain hook to rotate integrally with the curtain without acting against the forming of curtain wave, it is preferable that the body section has a width larger than the diameter of a leg section of the curtain runner to the length direction of the curtain rail. For easy and secure setting of the curtain hook, it is desirable that the foot section is smaller in width than the body section and formed with a projection opposite to the curtain and that the body section is formed with an opening opposite to and wider than the foot section.

The wider the selection range of the pitch of curtain hooks the more easy the height of curtain wave will be adjusted, so that the insertion hole sections are disposed to align at small intervals in the curtain or the curtain tape along the length direction of a curtain rail.

1st Embodiment

Figure 1:
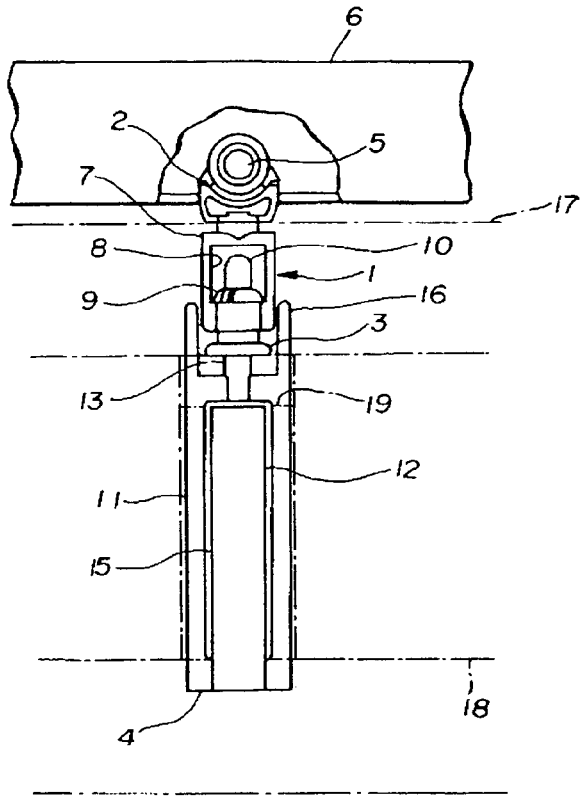
FIG. 1: a rear view of a relevant part of the curtain rail provided with the first embodiment.
Figure 2:
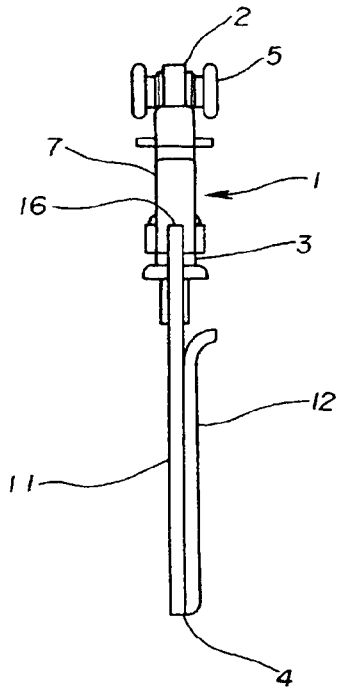
FIG. 2: a side view of the first embodiment.
Figure 3:
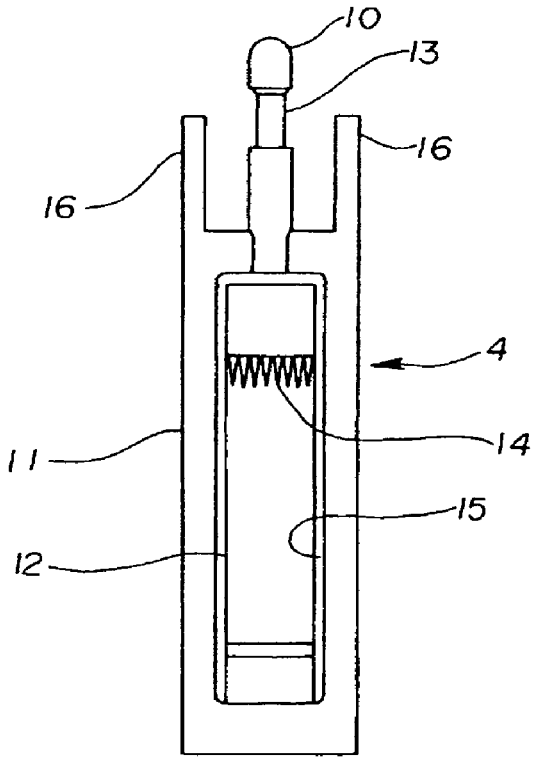
FIG. 3: a front view of the insertion-type hook.
Figure 4:
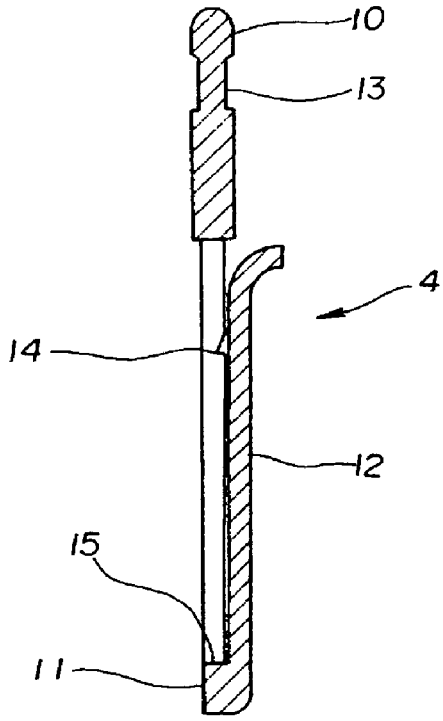
FIG. 4: a side view of the insertion-type hook.

The first embodiment relates to a wave forming mechanism having insertion-type curtain runners and insertion-type curtain hooks for use with a curtain except the lead and tail portions thereof. FIG. 1 shows a rear view of a relevant part of a curtain with the first embodiment, dotted lines indicating a curtain cloth and a curtain tape. FIG. 2 shows a side elevation of the first embodiment. FIGS. 3 and 4 show a front view and a longitudinal section of the insertion-type hook, respectively.

As seen in FIGS. 1 and 2, the insertion-type curtain runner 1 has a main body 2, a hollow-cylindrical body 3 supported rotatably about and vertically slidably along the vertical axis of the main body 2 and an insertion-type hook 4 removably inserted into the hollow-cylindrical body 3 from bottom. The main body 2 is provided with wheels 5 for running through a curtain rail 6. The main body 2 has a leg section 7 vertically downwardly passing through the curtain rail 6 and forming an annular section 8 into which the hollow-cylindrical body 3 is rotatably and vertically slidably inserted. The upper half portion of the hollow-cylindrical body 3 is shaped into a bearing section 9 that is axially slit and radially expandable. When the insertion-type hook 4 has a head section 10 inserted into the hollow-cylindrical body 3 from bottom, the hollow-cylindrical body 3 is moved to the upper position above the annular section, in which the bearing section 9 expands to have its open inner diameter larger than the head section 10 and allows an upward penetration of the head section 10. Thereafter, the hollow-cylindrical body 3 moves down to the original position in which the bearing section 9 has its closed inner diameter smaller than the head section 10 to support the penetrated head section 10 when the insertion-type hook 4 is freed.

As seen in FIGS. 3 and 4, the insertion-type hook 4 has a flat plate-like body section 11, a foot section 12 bent upward at the lower end of the body section 11 and a shaft section 13 extending from the body section 11 to form a thick head section 10. The foot section 12 is smaller in width than the body section 11 and formed with a projection 14 opposite to the body section 11. The body section 11 has an opening 15 opposite to and wider than the foot section 12 and both pins 16 extending upward from the both upper side ends of the foot section 11.

As seen in FIGS. 1 and 2, a curtain tape 18 sewed to a curtain 17 has hook insertion hole sections 19 each being perpendicular to the length direction of the curtain rail 6 and having such a width that is almost similar to the body section 11 of the hook 4 and larger than the diameter of the foot section 7 to the length direction of the curtain rail. The insertion-type hook 4 is stable both in position and in direction with the head section 10 projecting vertically perpendicular to the length direction of the curtain rail, when the hook 4 has its body section 11 inserted into the hook insertion hole section 19 of which the width is the same as the body section 11 and its foot section 12 engaged with the hook insertion hole section 19. At this time, the insertion-type hook 4 has its foot section 12 pressing the curtain tape 18 into the opening 15 of the body section 11 and its projection 14 stabbing at the curtain tape 18, so that a relative play between the insertion-type hook 4 and the curtain tape 18 is restricted to keep the head section 10 more stable both in position and in direction. Therefore, in contrast to the conventional insertion-type hook being unstable both in position and direction, it becomes a remarkably easy work to hold up the insertion-type hook 4 together with the curtain 17 and, from bottom, insert the head section 10 of the hook 4 into the hollow-cylindrical body 3 of the main body 2 when the curtain runner 1 is installed in the curtain rail 6. The suspended curtain forms a naturally elegant wave. The contour length of wave is defined by intervals among the hook insertion hole sections 19 into which the insertion-type hooks 4 are inserted.

2nd Embodiment

Figure 5:
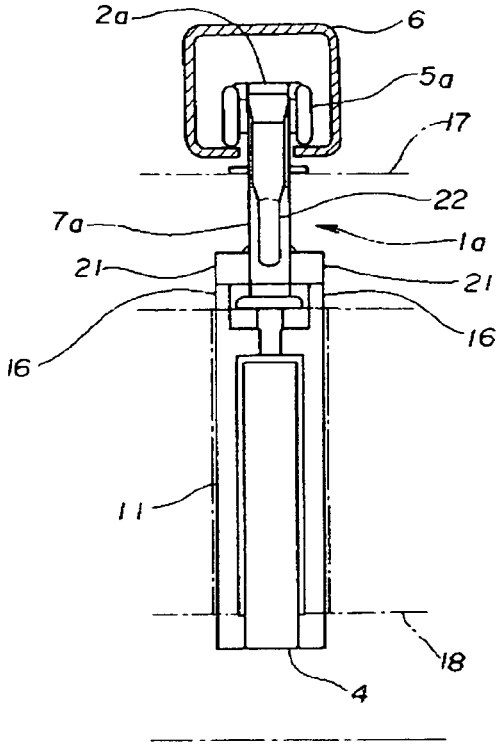
FIG. 5: a front view of a relevant part of the curtain rail provided with the second embodiment.
Figure 6:
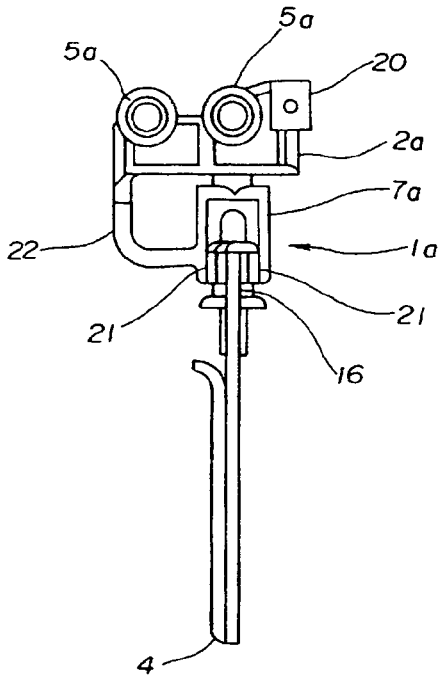
FIG. 6: a side view of the second embodiment.

The second embodiment relates to a curtain wave forming mechanism having insertion-type curtain runners and insertion-type curtain hooks for use with both the lead and tail portions of a curtain. FIG. 5 shows a rear view of the relevant lead or tail portion of the curtain equipped with the second embodiment, dotted lines indicating a curtain cloth and a curtain tape. FIG. 6 shows a side elevation of the second embodiment.

As seen in FIGS. 5 and 6, according to the second embodiment, the insertion-type curtain runner 1*a* with a magnet piece 20 is used for suspending the lead or tail portion of the curtain. The insertion-type curtain runner 1*a* has a main body 2*a* provided with two pairs of wheels 5*a* for running through the curtain rail 6. The main body 2*a* has a leg section 7*a* extending downward from the body 2*a* and being supported by an arm 22. The leg section 7*a* is integrally formed at the opposite sides of the lower portion thereof with receivers 21 which are perpendicular to the length direction of the curtain rail. The insertion-type hook 4 is inserted into the main body 2*a* from bottom in the same way as the first embodiment.

The receiver 21 has a couple of plates extending from the leg section 7*a* in the horizontal direction perpendicular to the length direction of the curtain rail and receiving two pins 16 integral with the hook 4 between the plates in order to prevent the insertion-type hook 4 from rotation and keep the direction of the flat plate-like body section 11 perpendicular to the length direction of the curtain rail 6. Then, the curtain 17 has its lead and tail portions hanging through the curtain tape 18 from the insertion-type curtain runners 1*a* and forming the lead and tail wave cycles which are always high and perpendicular to the length direction of the curtain rail 6. This means that the second embodiment is particularly effective to make wave cycles high in the lead and tail portions of the curtain in which the wave cycles have conventionally decreased. Except for those described above, the second embodiment is the same in construction and effect as the first embodiment.

Figure 7:
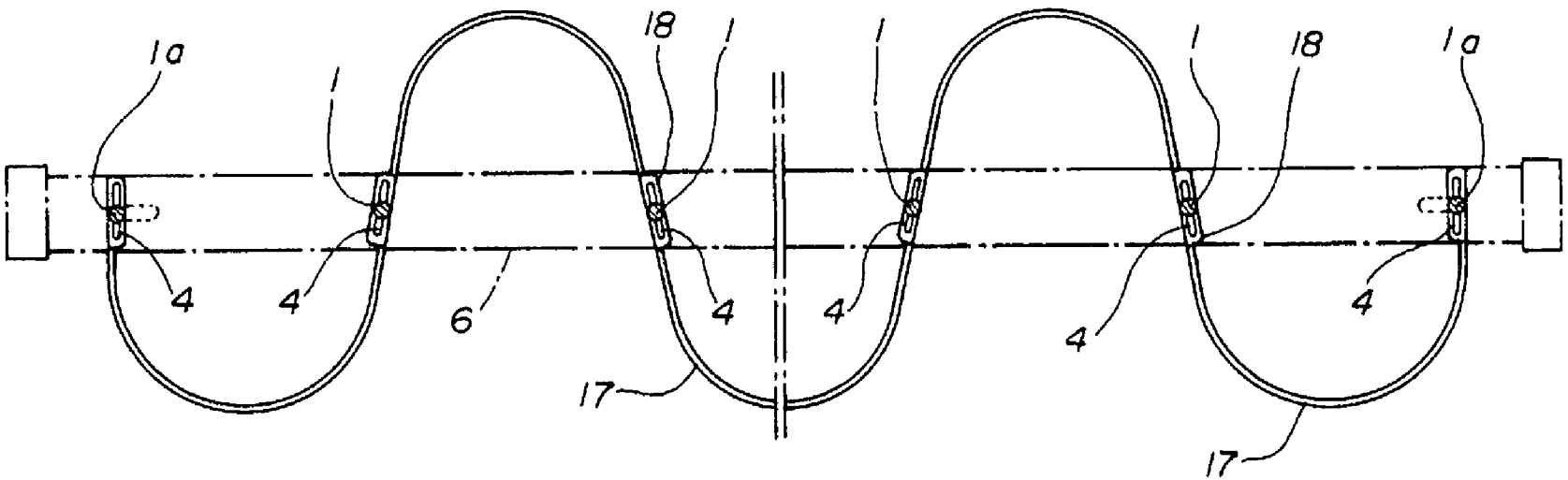
FIG. 7: a section, taken along the curtain tape, of the curtain with the first and second embodiments.

FIG. 7 shows a horizontal section taken along the curtain tape of the curtain of which the lead and tail portions are provided with the curtain runners 1 and 1*a* are lined up at regular intervals parallel to the length direction of the curtain rail 6 to determine wave nodes and wavelength through the intermediary of non-shown maximum-interval limiting means.

The wide insertion-type curtain hooks 4 are inserted into the hook insertion hole sections of the curtain tape 18 extending along the upper edge of the curtain 17, the hooks being the same in number as the curtain runners 1 and 1*a* in the curtain rail 6. In the middle portion except the lead and tail portions, the insertion-type curtain hooks are disposed at regular intervals to define the contour length of wave, which is larger than the interval of the curtain runners when the curtain is closed. In the lead and tail portions, the insertion-type curtain hooks are disposed at another interval slightly longer than the regular interval in the middle portion.

All the insertion-type curtain hooks 4 locate behind the curtain 17, when seen from the front side. In the middle portion, the insertion-type curtain hooks 4 are fitted in the respective curtain runners 1 to rotate integrally with the waving curtain in a manner that their flat plate-like body sections incline, in the opposite directions to one another, at an acute angle to the length direction of the curtain rail. In the lead and tail portions, the insertion-type curtain hooks 4 are fitted in the respective curtain runners 1*a* to have the flat plate-like body sections crossing perpendicular to the length direction of the curtain rail, so that the lead and tail portions of the curtain 17 project perpendicular to the front and form wave cycles similar in height to those in the middle portion of the curtain. This means that the curtain 17 form a curtain wave extending uniformly from the lead portion through the tail portion.

3rd Embodiment

Figure 8:
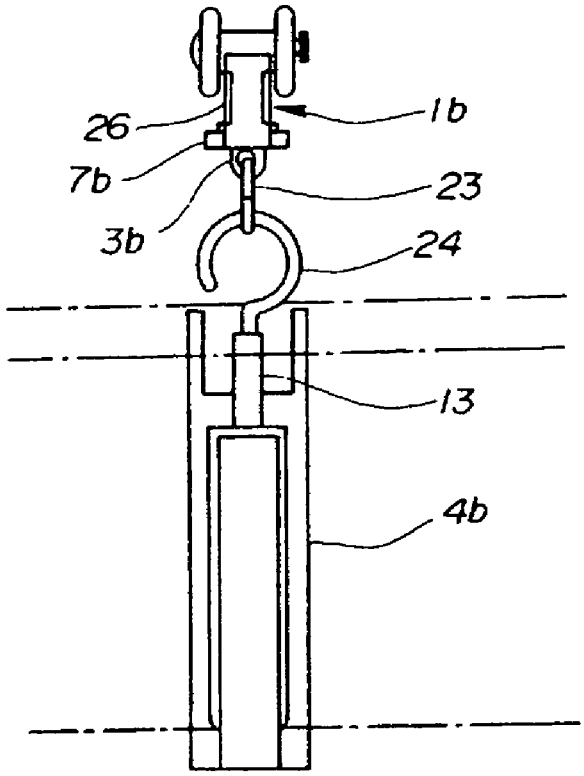
FIG. 8: a front view of the third embodiment.
Figure 9:
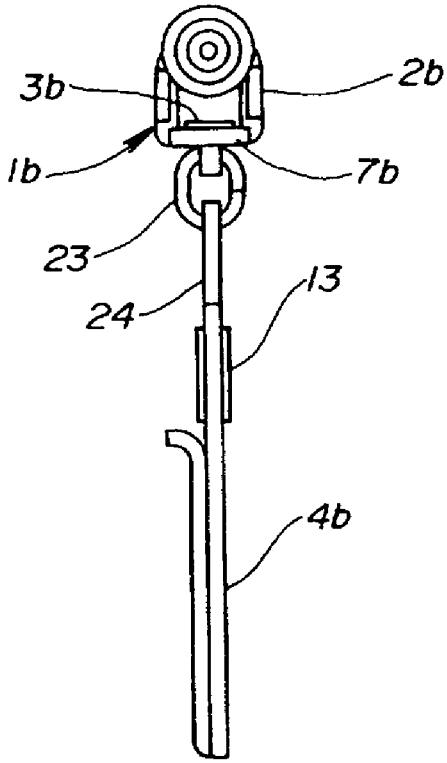
FIG. 9: a side view of the third embodiment.

The third embodiment relates to a curtain-wave forming mechanism having ring-type curtain runners and ring-type curtain hooks. FIGS. 8 and 9 show front and side elevations of the third embodiment, respectively. The ring-type curtain hook 4*b* is used for the known ring-type curtain runner 1*b*, as seen in the figures. The ring-type curtain runner 1*b* has a main body 2*b* running through the curtain rail, a leg section 7*b* extending downward from the body 2*b*, a cylindrical body 3*b* rotatably fitted on the vertical axis of the leg section 7*b*, and a ring 23 suspended from the cylindrical body 3*b*. The ring-type curtain hook 4*b* has its shaft section 13 formed at the upper end thereof with a hook 24. The ring 23 of the ring-type curtain runner 1*b* makes a hooking engagement with the hook 24. Except for those described above, the third embodiment is the same in construction and effect as the first embodiment.

The curtain wave forming mechanism according to the present invention is applicable to a curtain rail comprising a plurality of curtain runners installed in the curtain rail and curtain hooks fitted in the respective curtain runners for suspending a curtain.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A curtain wave forming mechanism comprising a plurality of curtain runners disposed in a curtain rail and curtain hooks each being fitted in one of said curtain runners for hanging a curtain, wherein:

each of said curtain hooks includes a flat-plate body section inserted vertically into a wide, vertical hook insertion hole section of a curtain tape of the curtain, the curtain tape extending along an upper edge of said curtain, a foot section bent upward at a lower end central part of said flat-plate body section to be hooked to said hook insertion hole section, a shaft section extending from an upper central part of said flat-plate body section, and a head section formed on an upper end of said shaft section, and each of said curtain runners includes a main body running in said curtain rail, a leg section of said main body hanging below said curtain rail, a cylindrical body supported at said leg section so as to be rotatable about a vertical axis of said leg section, and a bearing section fitted to said cylindrical body for supporting said head section of each of said hooks, wherein said flat plate body section of each of said curtain hooks is formed with a pin extending upward from each of two sides of an upper end of the flat plat body portion.

2. A curtain wave forming mechanism according to claim 1, wherein:

said flat-plate body section of each of said curtain hooks is substantially equivalent in width to widths of said hook insertion hole sections of said curtain tape, the widths of the hook insertion hole sections of said curtain tape extending parallel to a length direction of said curtain rail.

3. A curtain wave forming mechanism according to claim 1, wherein:

said foot section is smaller in width than a width of said flat-plate body section of each of said curtain hooks, said flat-plate body section being formed with an opening opposite to and wider than said foot section.

4. A curtain wave forming mechanism according to claim 1, wherein:

said foot section of each of said curtain hooks is formed with teeth projecting toward said curtain.

5. A curtain wave forming mechanism according to claim 1, wherein:

each of said curtain runners includes a receiver extending from said leg section in a horizontal direction perpendicular to a length direction of the curtain rail for retaining said pins of said curtain hooks.

6. A curtain wave forming mechanism according to claim 5, wherein:

said receiver includes parallel plates extending horizontally from said leg section and perpendicular to the length direction of said curtain rail.

7. A curtain wave forming mechanism according to claim 1, wherein:

said hook insertion hole sections of said curtain tape are disposed at relatively small intervals parallel to a length direction of said curtain rail.

* * * * *